US006878124B1

(12) United States Patent
Crowe

(10) Patent No.: US 6,878,124 B1
(45) Date of Patent: Apr. 12, 2005

(54) MASSAGE APPARATUS

(76) Inventor: Joseph W. Crowe, 133 Front St., Mineral Port, PA (US) 15942

( * ) Notice: Subject to any disclaimer, the term of this patent is extended or adjusted under 35 U.S.C. 154(b) by 488 days.

(21) Appl. No.: 09/655,813

(22) Filed: Sep. 6, 2000

(51) Int. Cl.[7] ..... A61H 15/00
(52) U.S. Cl. ..... 601/122; 601/119
(58) Field of Search ..... D24/214, 215; 601/118–123, 125, 131, 135, 134, 137, 63, 99, 128, 129

(56) References Cited

U.S. PATENT DOCUMENTS

| | | | | | |
|---|---|---|---|---|---|
| 444,597 | A | | 1/1891 | Lichtenstadt | |
| 718,594 | A | * | 1/1903 | Bailey | 601/120 |
| 1,111,427 | A | | 9/1914 | Archibald | |
| 1,630,149 | A | | 5/1927 | Wahrt | |
| 1,710,051 | A | | 4/1929 | Giacopazzi | |
| 2,011,471 | A | * | 8/1935 | Casagrande | 601/129 |
| 2,306,424 | A | | 12/1942 | Betz | |
| 2,578,916 | A | | 12/1951 | Belleville | |
| 3,415,514 | A | * | 12/1968 | Weihs | 482/79 |
| 4,648,387 | A | * | 3/1987 | Simmons | 601/120 |
| 4,712,539 | A | * | 12/1987 | Kim | 601/120 |
| 4,813,404 | A | * | 3/1989 | Vallis | 601/125 |
| 4,993,408 | A | | 2/1991 | Schweisfurth | |
| 5,016,619 | A | * | 5/1991 | Fitzpatrick | 601/120 |
| 5,709,705 | A | * | 1/1998 | Belcher | 606/204.35 |

FOREIGN PATENT DOCUMENTS

| | | | | |
|---|---|---|---|---|
| SU | 1821190 A1 | * | 6/1993 | 601/119 |

* cited by examiner

*Primary Examiner*—Danton D. DeMille
*Assistant Examiner*—Tam Nguyen
(74) *Attorney, Agent, or Firm*—John S. Hale; Gipple & Hale

(57) ABSTRACT

A massage apparatus for providing rolling massage of skin zones and reflex zones of the human body, the massage device comprising a handle defining a blind bore and a shaft removably mounted to the handle. The shaft is formed with a head having a flat rear surface which functions as a stop with the other end of the shaft being threaded to fit into the blind bore of the handle. A plurality of freely rotatable massage rings are mounted on the shaft, each massage ring having spaced teeth distributed uniformly around its circumference with each massage ring being spaced apart by a smaller diameter massage ring. Spacer washers are positioned at the ends of the aligned massage rings and mounted on the shaft adjacent the handle and the shaft head flat rear surface.

14 Claims, 1 Drawing Sheet

Fig 1
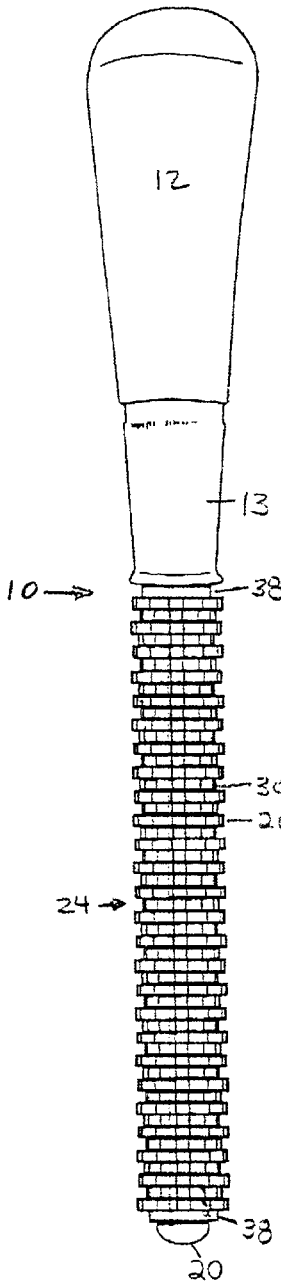
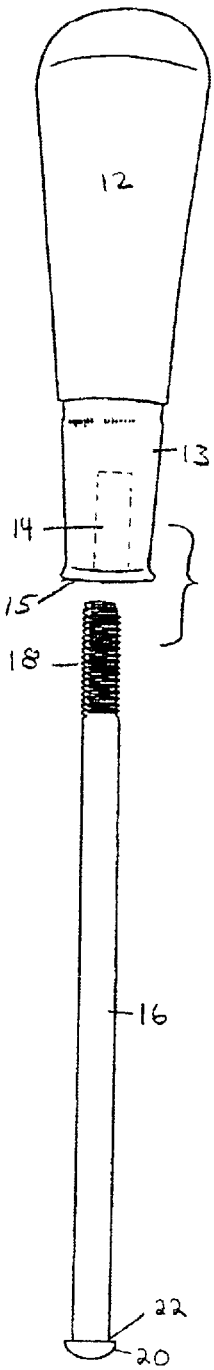
Fig 2
Fig 3
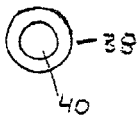
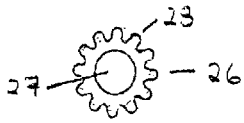
Fig 4
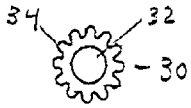
Fig 5
Fig 6
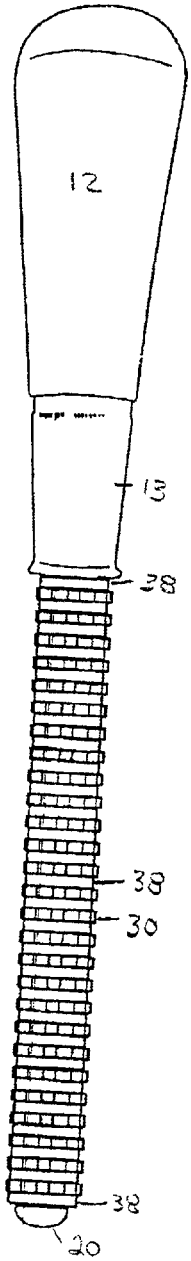

MASSAGE APPARATUS

BACKGROUND OF THE INVENTION

The present invention is generally directed toward a massage apparatus and more specifically, is directed to a massage apparatus with individually rotating elements for rolling massage of skin- and reflex zones of the human body.

A kneading penetrating action on the skin is an efficient way of applying a massage as this action tends to stimulate the blood and reach subcutaneous tissues which otherwise are not exercised in a manner which is conductive to a healthy skin. Fatty tissues are reached in this way and can be broken down.

There have been numerous devices in the prior art which have used rotating elements to provide massage to various areas of the body. One such device is the use of a series of balls or spheres mounted for rotation on a wire or strings which are pulled along the back of the user. An example of this construction is shown in U.S. Pat. No. 1,513,475. U.S. Pat. No. 444,597 discloses a magnetic massage device with copper disks and alternating zinc disks soldered together and rotatably mounted on a shaft. Each of the disks are provided with a plurality of nipples on their circumference edges.

U.S. Pat. No. 2,306,424 shows a massage assembly with a number of axially aligned shafts, each of which is provided with a number of bulb-like fingers which extend outward from the shaft. The respective shafts are mounted in a housing which has a curved handle secured to it and extending away from the housing.

U.S. Pat. No. 1,710,051 discloses another massage device with a plurality of axially aligned shafts mounted on a yoke which is attached to a handle. A plurality of round surfaced disks spaced by spacer sleeves are rotatably mounted on each shaft. The spacer sleeves are also mounted on each shaft.

U.S. Pat. No. 4,993,408 discloses a massage device having a shaft which may be angularly aligned which holds a number of rotatable rings having needle tips around the circumference. The shaft is provided with a flat bar projection at one end which engages a slit of a forked shaft located at one of the rod shaped handle. A bolt is inserted through holes in the two legs of the forked shaft and a hole in the bar attachment registering with holes and is screwed or riveted to each other so that the handle can be angularly adjustable with respect to the shaft carrying the massage rings.

It is seen that there is a need for a simply constructed massage apparatus which can be easily transported and cleaned removing built up skin oils and dermis which can collect on a massage apparatus and can provide a repository for bacteria growth thus presenting a potential health hazzard.

SUMMARY OF THE INVENTION

The present invention is directed toward a simple sturdily constructed massage apparatus having a single shaft removably mounted on a handle with a number of freely rotatable massage rings mounted on the shaft. The massage rings are provided with spaced teeth positioned uniformly around the circumference of each ring. The rings are of a staggered size diameter with a smaller ring being placed between larger sized massage rings. The ring teeth are slightly angularly turned with regard to the plane of the ring body to engage the skin over which the message device is moved, resulting in a deeper skin and area massage.

It is an object of the invention to provide a massage apparatus which will permit a masseur to work on stretched-out persons and enable the masseur to exert pressure on the portions of the body to be treated during the massage operation.

It is another object of the invention to provide a massage apparatus which will permit a an individual to exert pressure and massage on the portions of his or her own body during the massage operation.

It still another object to provide a portable massaging apparatus which may be operated equally as well by those skilled in the art of massage as by a person of much less experience in massage.

It is another object of the invention to provide a massage for the rolling massage of skin-and reflex zones, to achieve favorable therapeutic action allowing good surface massage to be performed on the painful parts of the body and/or the reflex zones concerned.

A further object of the invention is to provide an improved portable, light weight, compact and sturdy massaging device.

It is yet another object of the invention to provide a simple mechanism requiring little to no servicing and which has inexpensive massaging elements which are readily replaceable.

It is still another object of the invention to provide a simple massage apparatus which can be easily cleaned after usage.

These and other objects, advantages, and novel features of the present invention will become apparent when considered with the teachings contained in the detailed disclosure along with the accompanying drawings.

BRIEF DESCRIPTION OF THE DRAWINGS

FIG. 1 shows a side elevational view of the apparatus;

FIG. 2 shows an exploded view of the handle and shaft;

FIG. 3 shows a top plan view of a washer used in the invention;

FIG. 4 shows a top plan view of a toothed washer used in the invention;

FIG. 5 shows a top plan view of another smaller toothed washer used in the invention; and FIG. 6 shows a side elevational view of another embodiment of the massage apparatus.

Similar reference characters denote corresponding features consistently throughout the attached drawings.

DETAILED DESCRIPTION OF THE PREFERRED EMBODIMENT

The present invention is a rotating massage apparatus constructed to deliver localized massages. The preferred embodiment and best mode of the invention is shown in FIGS. 1 through 5.

The massage device 10, depicted in FIGS. 1 and 2, comprises a handle 12, with a threaded blind bore 14 which holds a threaded end 18 of a rod-shaped cylindrical shaft 16. The handle has a curved end and would be classified as a Type C file handle. The handle can be made of wood or plastic and has on its distal end, a metal sleeve 13 with a flat end surface. The cylindrical shaft 16 is threaded at one end 18 for a distance of ½ to 1 inch along the barrel of the shaft with the other or distal end of the shaft being formed with a hemispherical curved head 20 formed with a rear flat stop surface 22 encircling the shaft outer body. The shaft is preferably 5½ inches long ranging from 5 to 6 inches in length with a ¼ inch diameter. A plurality of freely rotatably supported massage rings 24 are rotatably mounted on the shaft 16. The massage rings 24 are in the form of alternating toothed different diameter washers 26 and 30. The massage rings are made of metal, preferably stainless steel but can be coated with chrome, nickle or other metals to reduce friction and allow rotation. If desired the massage rings can also be constructed of copper or brass. Massage ring 26 has a throughgoing center aperture 27 having a diameter of approximately 5/16 inch which is larger than the shaft 16 diameter. Massage ring 26 preferably has 12 teeth 28 arranged uniformly around its circumference and has an OD of 9/16 inches. Massage ring 30 is smaller then massage ring 26 with a throughgoing center aperture 32 of approximately ¼ inch and preferably has 12 teeth 34 arranged uniformly around its circumference and has an OD of ½ inches. The massage rings can be alternately provided with 10–16 teeth if so desired. The teeth 28 and 34 of the respective massage rings can be angled from 5 to 45 degrees from the plane of the massage ring body. The massage rings 26 and 30 can range in number from 30 to 60 each, totaling about 60 to about 120 together, but in the preferred usage 46 to 50 of each of the toothed rings are utilized. Spacer rings 38 having a throughgoing aperture 40 are located adjacent the shaft head stop surface 22 and the flat surfaced sleeve end 15.

In an alternate embodiment as shown in FIG. 6, the same handle 12 and shaft 16 are used with alternately spaced smooth surfaced washers 38 and toothed washers 30. Each of the massage rings 30 and the spacer rings 38 are positioned to provide a distance equal to the width of the washer spacer ring between the spaced massage rings 30 rotatably mounted around the shaft 16. The spacer than the diameter of the shaft 16 and each spacer washer has an outer diameter of about 5/16 of an inch.

The actual operative portion of the massage apparatus 10 is thus provided with a length dimension which permits simultaneous treatment of larger skin surfaces or reflex zone areas by an individual on himself or herself or by one person on another person. In operation the massage apparatus is rolled rapidly back and forth over the desired area with a moderate pressure for a period ranging from three to five minutes.

In the foregoing description, the invention has been described with reference to a particular preferred embodiment, although it is to be understood that specific details shown are merely illustrative, and the invention may be carried out in other ways without departing from the true spirit and scope of the following claims:

I claim:

1. A massage apparatus for a massage of zones of the human body comprising a handle, a cylindrical rigid shaft mounted to said handle, a plurality of freely rotatable massage rings mounted on the shaft, each massage ring comprising a body defining a throughgoing aperture and a plurality of teeth distributed uniformly around the circumference of the ring body, said teeth being angled with respect to a plane taken across the massage ring body, said massage rings including alternating rings with at least two different outside diameters with the massage rings with the largest diameter being alternately separated by a massage ring with a smaller diameter, said massage rings being sized to engage the human body, said shaft having an integral rounded head at one end of greater diameter then the body of the shaft but of a lesser diameter then the massage rings, said head being formed with a perpendicular flat stop for said massage rings, said shaft being threaded at its other end.

2. A massage apparatus as claimed in claim 1 wherein said handle defines a rounded end and a tapered distal end, a threaded blind bore is formed in said handle distal end running along a central axis of said handle to hold said rigid shaft, a cap member mounted on said handle distal end formed with an inwardly turned end flange portion defining a central aperture surrounding said bore, said end flange portion defining a flat end surface.

3. A massage apparatus as claimed in claim 1 wherein said shaft and said massage rings are constructed of metal.

4. A massage apparatus as claimed in claim 3 wherein said metal is stainless steel.

5. A massage apparatus as claimed in claim 3 wherein said metal is coated.

6. A massage apparatus as claimed in claim 5 wherein said coating is chrome.

7. A massage apparatus as claimed in claim 1 wherein each size of said plurality of massage rings range from 26 to 50 in number.

8. A massage apparatus for rolling massage of skin zones and reflex zones of the human body, the massage device comprising a handle and a rigid shaft removably secured to said handle, said shaft defining a head on one end with a flat stop surface and a cylindrical body, a plurality of freely rotatable massage rings ranging in number from about 26 to about 50 are mounted on said shaft body, each massage ring having a circular planar body with spaced teeth distributed uniformly around its circumference angularly positioned with respect to a plane of said ring body, some of said massage rings having a larger diameter and being spaced from each other by smaller diameter massage rings, each massage ring having a planar body with spaced teeth distributed uniformly around its circumference, said teeth being angularly positioned with respect to a plane of said ring body, said angled teeth having vertical side and end walls and a planar top surface, said angled teeth being angled from about 5 degrees to about 45 degrees from a plane drawn through the circular planar body of said massage ring with the teeth ends intersecting said plane and extending away from said plane within about the 5° to about 45° range and spacers positioned at the ends of the massage rings adjacent said handle and said shaft head.

9. A massage apparatus according to claim 8 wherein said smaller diameter massage rings are replaced by circular spacer rings with a smooth circumference edge, said circular spacer rings being mounted between adjacent massage rings, the spacer rings having a thickness dimension at least equal to the thickness of said massage rings.

10. A massage apparatus according to claim 8 wherein said shaft has a length ranging from 5 to 6 inches.

11. A massage apparatus as claimed in claim 8 wherein said massage rings are constructed of metal.

12. A massage apparatus as claimed in claim 11 wherein said metal is stainless steel.

13. A massage apparatus as claimed in claim 11 wherein said metal is coated with a metal.

14. A massage apparatus for rolling massage of skin zones and reflex zones of the human body, the massage device comprising a handle and a rigid shaft removably attached to said handle, said shaft defining a cylindrical body with a head at one end with a flat stop surface, a plurality of freely rotatable massage rings are mounted on said shaft axis, said plurality of aligned massage rings numbering over 50, said massage rings comprising a first set of larger diameter massage rings having a planar circular body with a plurality of spaced teeth distributed uniformly around its circumference with the ends of said teeth being at a uniform angle to a plane of said circular body, each larger diameter massage ring being sequentially spaced by a smaller diameter massage ring having a planar circular body with a plurality of spaced teeth distributed uniformly around its circumference at a uniform angle to a plane of said circular body, said angle for each tooth end from about 5° to about 45° degrees from a plane drawn through the planar circular body and extending on either side of said plane and a circular smooth planar surfaced spacer positioned at the ends of said aligned massage rings adjacent said handle and said shaft head flat stop surface.

* * * * *